US005551756A

United States Patent [19]

Gurasich et al.

[11] Patent Number: 5,551,756

[45] Date of Patent: Sep. 3, 1996

[54] ORTHOTIC WHEELCHAIR POSITIONING DEVICE AND SUPPORT SYSTEM

[75] Inventors: William G. Gurasich, Austin; Mark H. Bussell, Fort Worth, both of Tex.

[73] Assignee: Custom Orthotics, Inc., Austin, Tex.

[21] Appl. No.: 214,091

[22] Filed: Mar. 16, 1994

[51] Int. Cl.[6] ..... A61G 5/10

[52] U.S. Cl. ..... 297/440.20; 297/338; 297/354.12; 297/440.22; 297/452.28

[58] Field of Search ..... 297/338, 354.12, 297/383, 440.20, 440.22, 452.25, 452.31, 452.36, 452.28

[56] References Cited

U.S. PATENT DOCUMENTS

| | | | |
|---|---|---|---|
| 3,549,201 | 12/1970 | Wolfe | 297/284.1 |
| 3,749,442 | 7/1973 | Berg et al. | 297/452.31 X |
| 4,588,229 | 5/1986 | Jay | 297/459 |
| 4,643,481 | 2/1987 | Saloff et al. | 297/452.25 |
| 4,646,374 | 3/1987 | Shafer | 5/481 |
| 4,647,066 | 3/1987 | Walton | 280/657 |
| 4,660,238 | 4/1987 | Jay | 5/431 |
| 4,678,202 | 7/1987 | Jensen et al. | 297/DIG. 4 X |
| 4,726,624 | 2/1988 | Jay | 297/459 |
| 4,728,551 | 3/1988 | Jay | 428/76 |
| 4,761,843 | 8/1988 | Jay | 5/431 |
| 4,842,330 | 6/1989 | Jay | 297/4 |
| 4,955,624 | 9/1990 | Jeun-Long | 280/42 |
| 5,018,790 | 5/1991 | Jay | 297/458 |
| 5,035,467 | 7/1991 | Axelson et al. | 297/440.2 X |
| 5,062,677 | 11/1991 | Jay et al. | 297/444 |
| 5,074,620 | 12/1991 | Jay et al. | 297/337 |
| 5,085,488 | 2/1992 | Dal Monte | 297/452.31 X |
| 5,102,195 | 4/1992 | Axelson et al. | 297/440 |
| 5,127,709 | 7/1992 | Rubinstein et al. | 297/440.2 |
| 5,149,173 | 9/1992 | Jay et al. | 297/284.9 |
| 5,195,803 | 3/1993 | Quintile | 297/365 |
| 5,211,446 | 5/1993 | Jay et al. | 297/444 |

FOREIGN PATENT DOCUMENTS

| | | | |
|---|---|---|---|
| 363330 | 4/1990 | European Pat. Off. | 297/452.28 |

OTHER PUBLICATIONS

Excerpts from an Otto Bock, Inc. author unknown. Literature published date unknown except before Mar. 16, 1993. (14 pages assorted).

*Confor Ergonomic Urethane Foams,* Division, Cabot Safety Corporation.

*Adult Modular Orthotic Seating System,* Wheelchair Seating Accessories.

*Cushioning to Benefit Tissue Viability,* Rehabilitation Report by R. H. Graebe.

Creative Rehabilitation Equipment – Parts Catalog© 1991.

*Primary Examiner*—Peter R. Brown

*Attorney, Agent, or Firm*—Gunn, Lee & Miller, P.C.

[57] ABSTRACT

A wheelchair support system fully adjustable to fit different-sized patients and attachable to the frame of a wheelchair. The support system includes a generally rectangular molded seat, a molded back shell and brackets for attaching to the frame of the wheelchair, the brackets being capable of adjustably positioning the back and seat to an individual patient's requirements, as well as capable of moving the system from one wheelchair to another without losing these adjustments.

18 Claims, 14 Drawing Sheets

13
48
42
36

13
40
32
46
46
32
35
30
44
42
44
32
38
13
13
42
13
44
44
34

106

106
114
120

106
114
118
110
116
112
108

122

122
120

122
114
110a
108
112a 129
125
127

ORTHOTIC WHEELCHAIR POSITIONING DEVICE AND SUPPORT SYSTEM

FIELD OF THE INVENTION

Support system for a wheelchair patient, more specifically, a fully adjustable positioning support system for quickly releasably attaching to the frame of a wheelchair and having a harness.

BACKGROUND OF THE INVENTION

The traditional sling seat found in the foldable wheelchair suffers from numerous drawbacks. When a person sits in a wheelchair with a sling shaped seat, an unfavorable relationship between the hip and spine develops. The pelvis shifts into a posterior pelvic tilt which results in discomfort, lower back pressure and a strong tendency to slide forward.

There has been considerable evolution from the early sling support straps developed for use in wheelchair seating. Development recently has taken place in which contoured seat and back surfaces, designed to relieve pressure spots, have been provided to ensure a comfortable environment for the patient's well-being and productivity. These seating systems are sometimes detachable from the wheelchair base, while others simply sit on top of the slings.

Present wheelchair seating systems sometimes use rigid frames which do not allow for changing the position of the user, e.g. changing the angle of and between the seat and back positions. Some wheelchair seating arrangements have allowed for variation in the angle of tilt, but use complicated and expensive parts, adapted to fit a conventional wheelchair base.

Further, conventional cushions for seat and back portions of wheelchair support systems, even those filled with gel, air or foam, do not take into account the individual size and shape distinctions between the musculature and skeletal variations found from individual to individual patient.

Variation in tilt angle of the seat and the back of a wheelchair support system is important. Changing the tilt angle provides a redistribution of the weight and a reduction of pressure related problems such as pressure sores and the like.

Harness systems are desirable to prevent patient slumping and the musculature and skeletal related problems caused by slumping. For example, patients can sometimes slump side to side, slump forward, or slide posteriorly forward in the chair if they are not safely harnessed in. Such harnesses, however, should provide for quick and easy release by the patient in case of emergency.

A wheelchair support system should have all the advantages herein described, as well as the ability to be quickly and toolessly removed without altering the adjustments previously made to the wheelchair system to fit individual patients. That is, when the physical therapist first fits the system to the patient adjustments are made for fitting the individual patient's body frame with respect to the needed floor length, seating depth and femur length, as well as tilt requirements before appropriate pressure relief on the spine and buttocks. When the system is quick released from the wheelchair frame for transportation, it does not interfere with a change to these adjustments.

Molded bases, combined with moldable foam cushions allow the seat and back to conform to the individual anatomy of the patient, providing continuous custom fit, even as the patient shifts about in the chair. The molded foam, when combined with the molded ABS base seat and back, must be correctly positioned to avoid pressure in the coccyx, sacral or spinal area. That is, the seat and back of the wheelchair support system must distribute and download pressure from bony protuberances to reduce the risk of pressure sores.

It is further desirable to provide a seating system that will decrease the inter-discal pressure in the lumbar portion of the spine, thereby creating proper lordotical curvature.

In short, the desirable seat, cushion, adjustment and harness features described above are highly desirable and do not heretofore appear in a single seating system. Moreover, to provide the advantages set forth above in a system which is quickly, easily and toolessly removable from the frame of a wheelchair without changing the adjustment settings, without interfering with adjustments in tilt and adjustments to accommodate patient's individual body frame and measurements which provides additional advantages. The features described above will assist in skeletal alignment, enhance comfort and decrease fatigue, while increasing the ability of a patient to sit in a chair for long periods.

Last, further advantages are provided for in a system with all the features set forth above which is easily fitable to a standard, conventional wheelchair frame with only the use of simple hand tools and which further provides easy removal of the wheelchair support system for transfer of the system from one wheelchair frame to another.

The advantages set forth above and other objects are provided for in the present invention which provides a seating system that replaces the slings and is easily attached to and removed from the frame of a conventional wheelchair.

It is another object of the present invention to provide for a wheelchair support system attachable to the frame of a wheelchair and having a rectangular seat and back which include contour molded bases.

It is another object of the present invention to provide for a wheelchair support system which has a generally rectangular base and back and additionally provides a harness for securing the patient to the seat and back, the harness having lap belt and shoulder straps secured to the frame of the wheelchair.

It is an additional object of the present invention to provide for a wheelchair support system having a rectangular seat and base, for attachment to the frame of a wheelchair where the attachment provides easy release from the frame and further provides for adjustment of the seat and back with respect to the frame of the wheelchair.

It is further object of the present invention to provide for a wheelchair support system capable of being attached and removed from the wheelchair frame without drilling, welding, cutting, or otherwise defacing or altering the wheelchair frame, and without altering the adjustment settings.

It is yet another object of the present invention to provide for an adjustable, removable wheelchair support system for attachment to the frame of a wheelchair, the wheelchair support system comprising of a seat and a back which are adjustable up and down, for and aft and in angular relationship between the seat and back.

It is still another object of the present invention to provide for an adjustable, removable wheelchair support system with a seat comprised of foam, selected by patient weight, which softens and deforms on contact with a warm, dermal surface of the patient to provide for an even distribution of the weight of the patient upon the seat.

It is yet another object of the present invention to provide for an adjustable, removable wheelchair support system having a seat and a back made of molded ABS, the seat having a depression positioned beneath the coccyx of the patient and the back having a channel rearward of the spinal column of the patient to prevent pressure buildup in the skin and tissue area adjacent bony protuberances.

DETAILED DESCRIPTION OF THE PREFERRED EMBODIMENT

Figure 1:
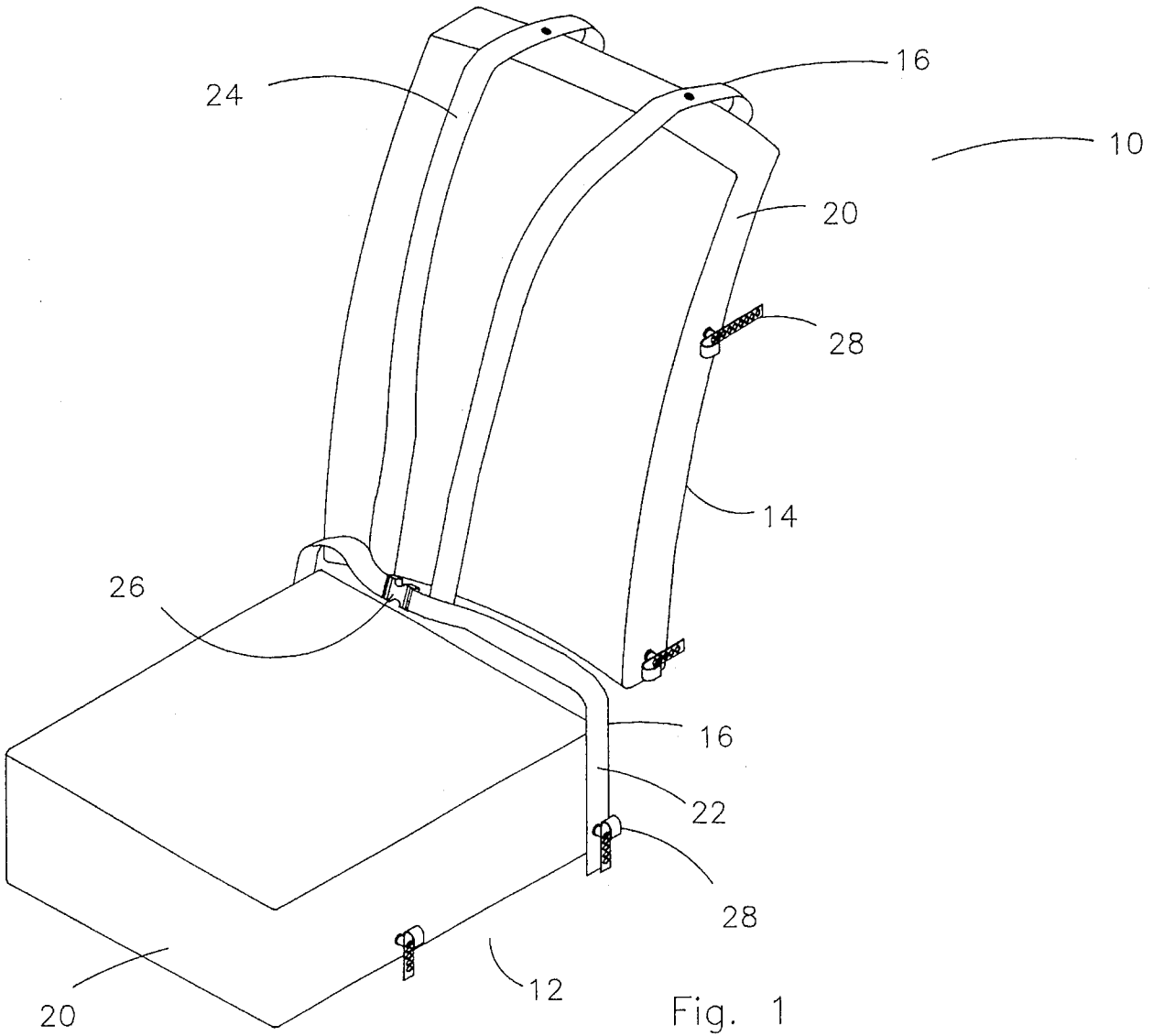
FIG. 1 is a perspective view of the support system of applicant's present invention including the seat, back and harness.

FIG. 1 illustrates a perspective view of some components of the support system (10) of applicant's present invention, including a generally rectangular seat (12) for vertical support of the patient thereon, a generally rectangular back (14) to provide lumbar and sacral support to the patient and a harness (16) attached at two points to back (14) and the edges of seat (12) to provide assistance in upper body supporting and positioning the patient. Both seat (12) and back (14) are provided with a durable, fluid-proof cover (20) with the capability of conforming in two-way stretch, such as the vinyl cover sold under the trademark LAVANTI sold by Gencorp Polymer Products, Inc.

FIG. 1 further illustrates the details of harness (16) including lap belt (22), comprised of two segments, each attached at a far end to opposite sides of seat (12) at the rearward portions thereof, the lap belt segments at a near end being connected by a quick release buckle (26). Two shoulder straps (24) depend from attachment points at the top wall at a top of back (14) to attach adjacent quick-release buckle (26) to lap belt (22).

Last, FIG. 1 illustrates a portion of the hardware of quick-release means hardware (28) of applicant's support system (10). Details of the quick-release hardware are provided with reference to FIGS. 5A through E, 6, 7, and 8 below.

Figures 2A, 2B, 2C, 2D, 2E:
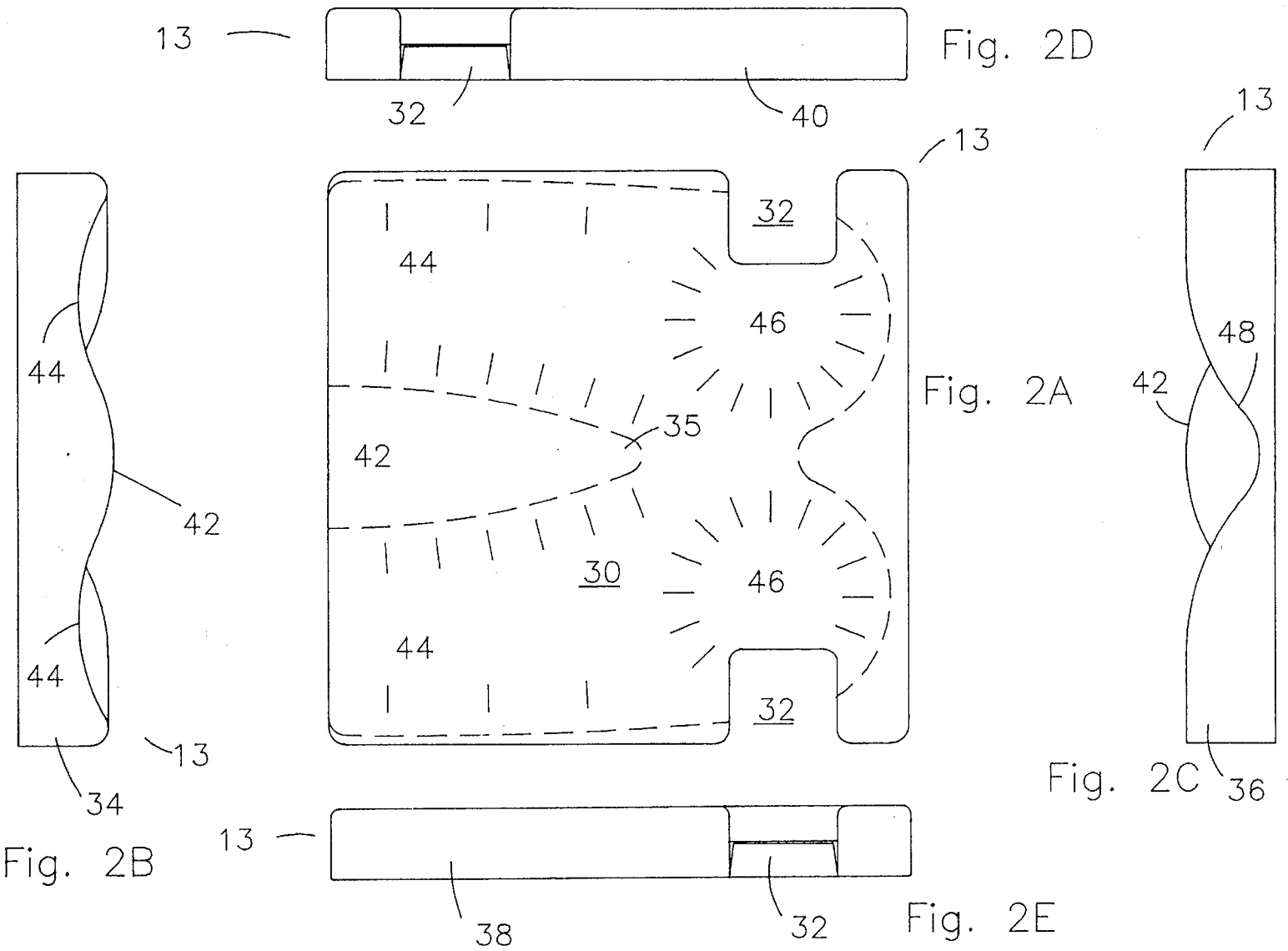
FIG. 2A is a top view of the shell of the seat of applicant's present invention.
FIG. 2B is a front elevational view of the shell of the seat of applicant's present invention.
FIG. 2C is a rear elevational view of the shell of the seat of applicant's present invention.
FIG. 2D is left side elevational view of the shell of the seat of applicant's present invention.
FIG. 2E is a right side elevational view of the shell of the seat of applicant's present invention.

With reference to FIGS. 2A through E, it is noted that seat (12) includes a support base comprising an ABS molded seat shell (13), the views of which are represented with reference to FIGS. 2A through E. Specifically, FIG. 2A illustrates a top elevational view of seat shell (13). It is seen that seat shell

(13) has a top surface (30), the top surface being contoured as hereinafter described and further having sidewall cut-outs (32) in the rear portion thereof to allow for clearance of X braces. It is further seen with reference to FIGS. 2A through E how top surface (30) has front, rear, right side and left side walls (34), (36), (38), (40) depending vertically downward from the top surface thereof.

Turning now to the contours of top surface (30), it is seen with reference to FIGS. 2A, 2B, and 2C that the top surface has a number of high areas or ridges and a number of depressions, wells, or low areas. In this manner, the molded contoured surface of seat shell (13) is designed to relieve localized high areas of pressure in the contact area between the patient and the seat. More specifically, the molded contours of seat shell (13) provide an inter-thigh ridge (42), leg channels (44), buttocks wells (46), and a coccyx well (48). The inter-thigh ridge (42) is centrally located along a bilateral axis of seat shell (13) beginning at front wall (34) and tapering therefrom to a point (35) approximately midway between front wall (34) and rear wall (36).

Turning now to leg channels (44), it is seen with reference with FIGS. 2A and 2B, that leg channels (44) provide a depression in top surface (30) lateral to inter-thigh ridge (42) and extending from front wall (34) rearward to circular depressions defining buttocks wells (46). Last, FIG. 2C illustrates coccyx well (48) centered along the bilateral axis at rear wall (36) where the profile of the wall dips to provide relief to the coccyx, the "tailbone" located at the terminus of the spinal cord and protruding downward therefrom, providing relief for what would otherwise be a high pressure point on the patient's posterior.

Thus, it is seen how top surface (30) is shaped to adapt to the anatomy of a typical patient's posterior and thigh region with depression channels for legs, wells for the buttocks, a pressure relief well for the coccyx and an inter-thigh ridge which falls between the inner thighs of the patient normally seated on support system (10).

The width of applicant's seat shell (13) is narrower in width than the prior art, typically 14 to 16 inches, preferably 15 inches, and has large, sidewall cut-outs to facilitate retrofitting to a wider variety of wheelchair designs than is presently available. Further, seat shell (13) is molded to a thinner dimension, typically in the range of 0.250 inches to 0.325 inches rather than the standard 0.375 inch thickness, to provide for weight and cost savings. The abduction area is not as deep as the prior art; measuring from the front to the back of the seat, it is typically in the range of 17 to 19 inches, preferably 18 inches. This results in less pressure on the crotch area and provides for more sitting area and more room for the legs.

FIGS. 3A through E illustrate the manner in which back shell (15) is contoured to relieve pressure from bony protuberances lying along the portion of the patient's back typically in contact with back (16) of support system (10). More specifically, back shell (15) is provided with a contoured front surface (50) on which there is, centrally located along the trace of a bilateral axis of front surface (50), a backbone channel (52). Depending generally perpendicular rearward from front surface (50) are top wall (54), bottom wall (56), inside walls (58). With reference to sidewalls (58), it is seen in dashed lines how backbone channel (52) begins as an elongated, generally rectangular depression centrally located at bottom wall (56) and continues upward approximately two-thirds of the way up the bilateral axis towards the top wall (54), eventually integrating with and blending into the remainder of top surface (50) at point (59).

Figure 3C:
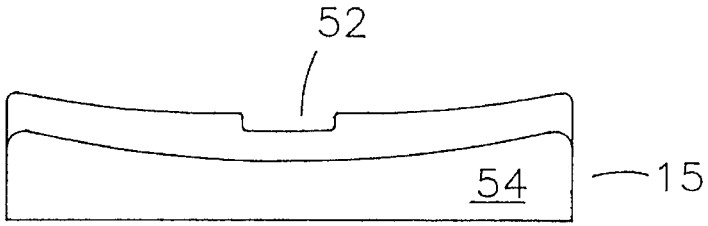
FIG. 3C is a top elevational view of the shell of the back of applicant's present invention.
Figure 3D:
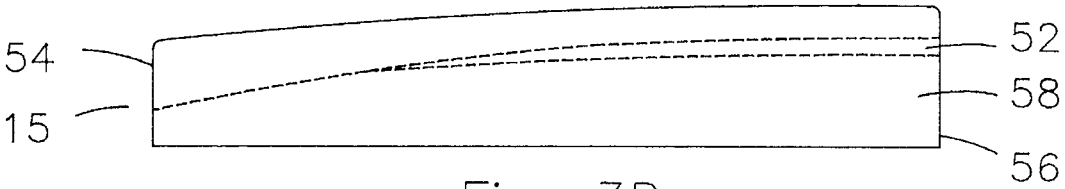
FIG. 3D is a side elevational view showing the curvature of the seat shell and showing the channel lines.
Figure 3B:
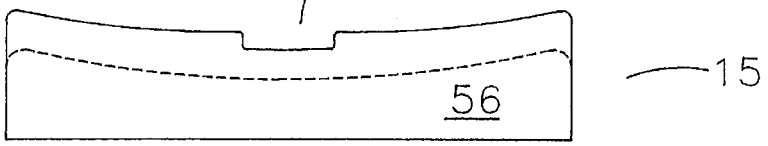
FIG. 3B is a bottom elevational view of the shell of the back of applicant's present invention.
Figure 3A:
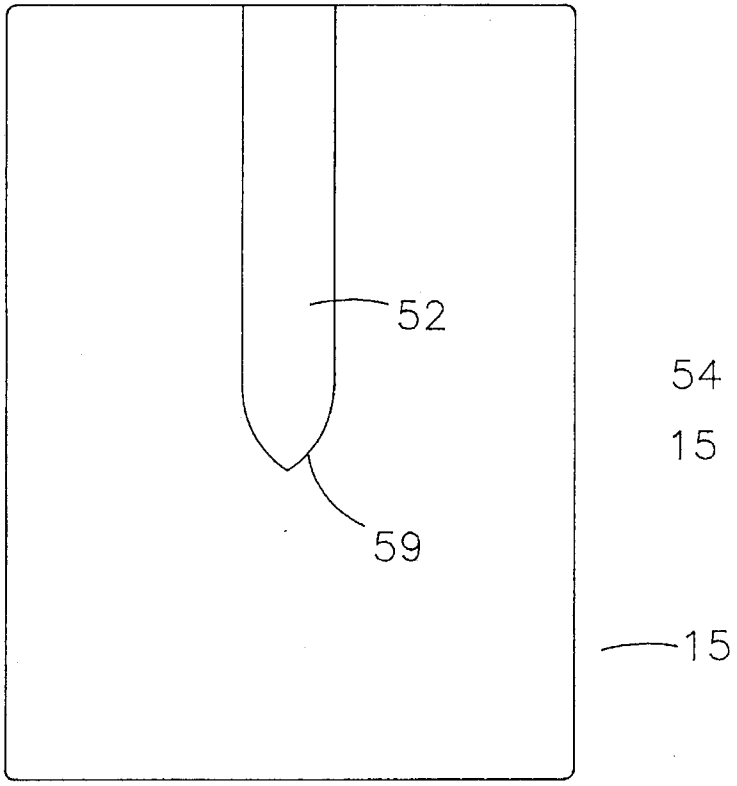
FIG. 3A is a front elevational view of the shell of the back of applicant's present invention.

Also, appreciated with reference to FIGS. 3B through 3C, is the profile of back shell (15) and more particularly, the manner in which it tapers to provide for greater thickness at bottom wall (56) than at top wall (54). Last, it is appreciated with reference to FIGS. 3B and 3C that back shell (15) is thinner in the middle than at side walls (58). Both of these features, combined with backbone channel (52), provide for a back shell (15), typically formed from molded ABS, which conforms to the general physiology and posture of a seated wheelchair patient.

There are a number of significant differences between back shell (15) and the prior art. First, applicant's back shell is narrower in width so as to facilitate retrofitting to a wider variety of wheelchair frames. The typical width of applicant's back shell (15) is between 14 and 16 inches, preferably 15 inches. Second, applicant's back shell (15) is molded to a thinner dimension, typically in the range of 0.250 to 0.325 inches, compared to a 0.375 inch thickness of typical back shells. This thinner dimension provides for weight and cost savings. Last, it should be noted that backbone channel (52) is sufficiently wide, typically about 2½ inches, to provide for increased user comfort.

It will be seen with reference to FIGS. 4A and 4B below, how, by providing back and seat shells that are molded to conform to a typical patient's anatomy, that adding a heat deforming foam that will deform the surface of seats and back to take the general seat shape and more specifically mold it to individual variations within the range typically found in human anatomy, a comfortable, anatomically correct, individualized pressure relieving seating system is realized.

Figure 4C:
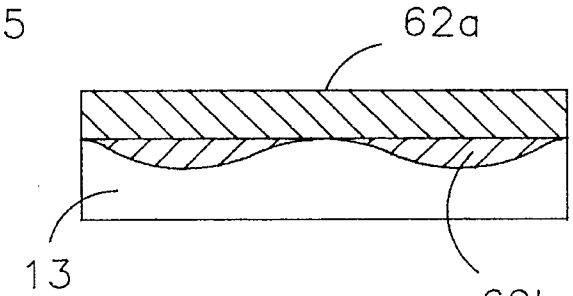
FIG. 4A is a side elevational view of the seat and back of applicant's present invention with the covers removed.
FIG. 4B is a side elevational view of the seat and the back of applicant's present invention with the covers and quick release means attached and also showing the range of tilt movement of the seat and back.
Figure 4A:
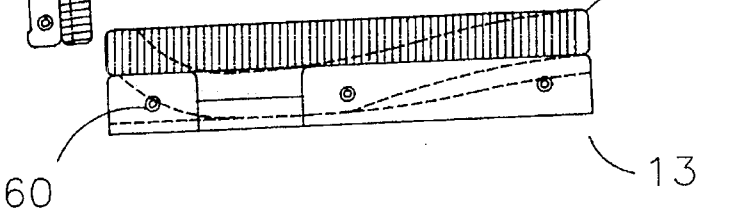
Figure 4B:
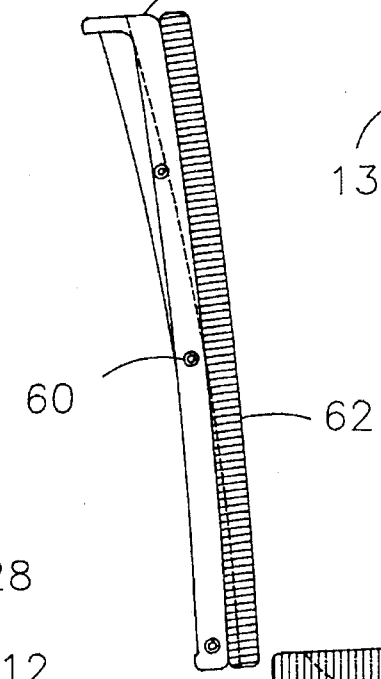
Figure 4B:
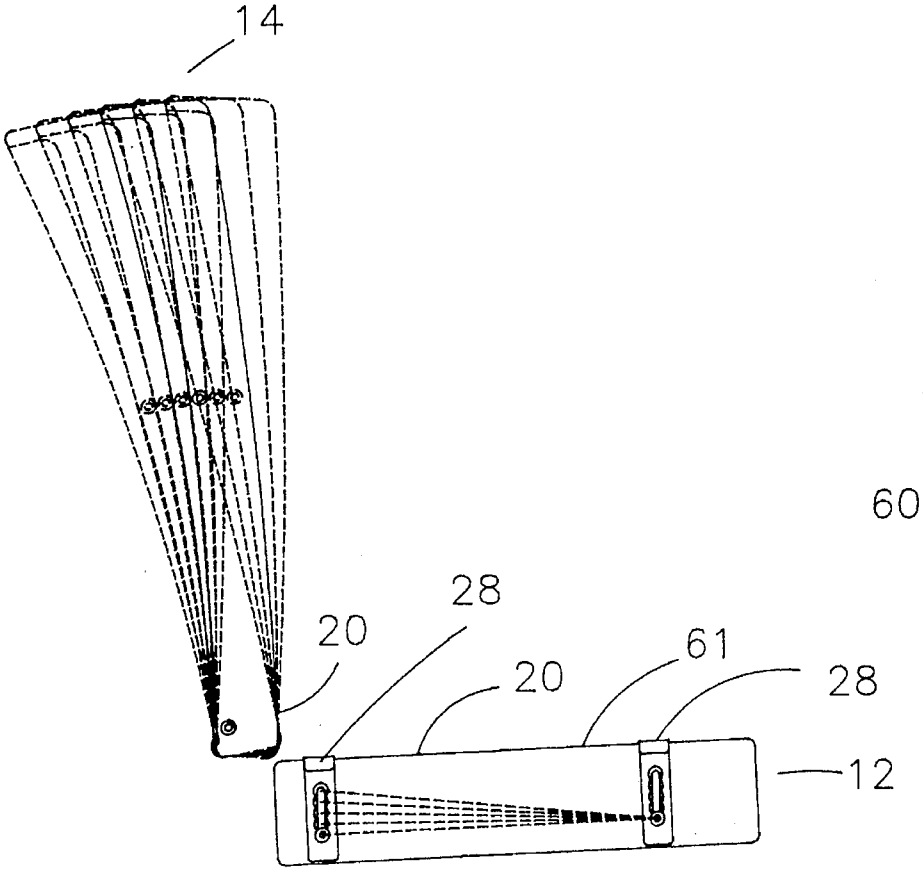

FIGS. 4A, 4B, and 4C illustrate additional details of applicant's seat and back. More specifically, FIG. 4A illustrates seat shell (13) and back shell (15) having foam overlay (62). FIG. 4B illustrates the manner in which quick release means (28) is affixed to the side of seat (12) to provide a tilt or angular relationship with back (14). Likewise, back (14) pivots and tilts with respect to seat (12). These two features provide a range of tilt between zero and five degrees for seat and zero and fifteen degrees for back (14). Zero degrees for seat is a horizontal position with seat as depicted in FIG. 4B. Five degrees is the angle created between the horizontal and top edge (61) of seat (12). In a like manner, zero degrees for seat (20) is be a vertical or upright position with fifteen degrees being a tilt back position of seat (14) with respect to the vertical.

Turning now to FIGS. 4A and 4C, details of foam overlay (62) are provided. It is recalled how applicant's seat shell (13) is molded to fit the general anatomical profile of an applicant's posterior, including thighs, buttocks, crotch and coccyx. However, within the general profile of such features is a large range of individual differences depending upon weight, size and specific skeletal and muscular system differences between individuals. Applicant's unique foam overlay of a contoured seat, however, provides for heat molding foam, sensitized and deformable under the body heat of a patient sitting on the seat, to deform and retain the memory of the specific profile of the patient's posterior. FIG. 4C illustrates the use of multiple ply, multiple density foam overlay (62) on seat shell (13). Here, applicant provides two layers of foam (62A and 62B), the layers being comprised of foam of different density. Layer 62A will have a lower density than layer 62B. Typically, layer 62A will have a nominal density of approximately 5.8 (lb/ft$^3$). The density of layer 62B will be light, medium or heavy, depending upon whether the seat is being built for patients in the light (125 lbs and under lbs), medium (126 lbs to 175 lbs), or heavy (over 176 lbs.) range. Not only is applicant's foam deformably overlay of multiple ply, multiple density foam unique, but it further provides the feature of heat-deforming to the specific patient's physiology.

Applicant's two-ply system uses two different densities of foam and is loaded onto the seat shell frame (13) one layer at a time. The contour of layer (62*b*) matches the contour of seat shell (13) and is in one piece, that is, without seams, though this may be difficult to appreciate from viewing FIG. 4C. Obviously, layer (62*a*) has no seams either. Applicant, by using seamless layers (layers not made up of individual pieces) provides a more comfortable seat with less chance of seams separating and causing discontinuities in seat support.

FIG. 4A illustrates back shell (15) having a single-ply foam overlay (62). The use of a single-ply overlay offers a number of advantages. It provides more upper torso stability than typical multi-ply designs, is simpler and less expensive to produce and offers a slight weight savings.

E-A-R Specialty Composites of 7911 Zionsville Road, Newark, Del. 19713 provides a CONFOR™ ergonomic urethane foam in a variety of densities having high energy absorption properties and temperature softening behavior. The CONFOR™ foam provides highly comfortable, firm support for pads and wheelchairs. The CONFOR™ foam softens on contact with a warm surface, such as the patient's body, allowing uniform pressure distribution and a firm, yet fluid support. The CONFOR™ open cell foam is breathable and non-irritating on dermal contact, making it ideal for medical applications. CONFOR™ provides foam of varying densities. For example, the CONFOR™ CF-47 (green) provides a compression set (percent deflection from original height) (AHTM-D3574) of 0.3. The CONFOR™ CF-45 (blue) and CF-42 (pink) have compression sets of 0.4 and 0.9 respectively. One of these three products typically provides for a second ply underlaying first ply (62A), second ply (62B) being light, medium or high (CF-47, 45, or 42) respectively for providing seats individually tailored for light, medium, or heavy weight patients. More details regarding the CONFOR™ ergonomic urethane foam are provided for in Technical Data Sheet TDS-13 produced by EAR Specialty Composites, the specifications and illustrations of which are incorporated herein by reference.

Figure 5B:
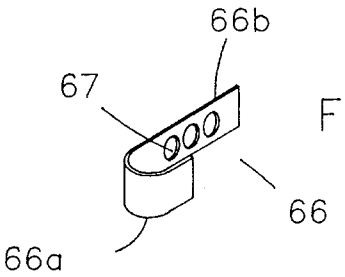
FIG. 5B is a perspective view of the three-holed "J" hook.
Figure 5E:
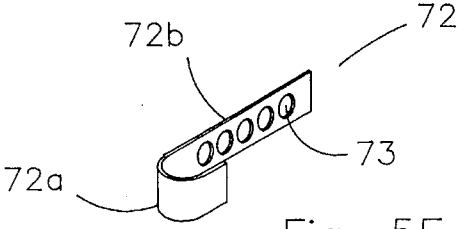
FIG. 5E is a perspective view of the five-holed "J" hook.
Figure 5D:
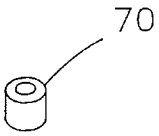
FIG. 5D is a perspective view of the spacers.
Figure 5C:
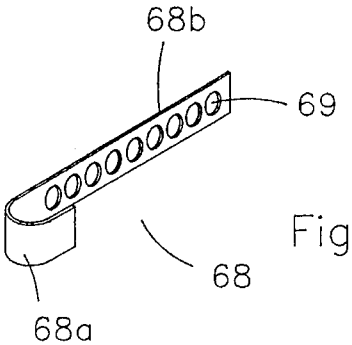
FIG. 5C is a perspective view of the nine-holed "J" hook.
Figure 5F:
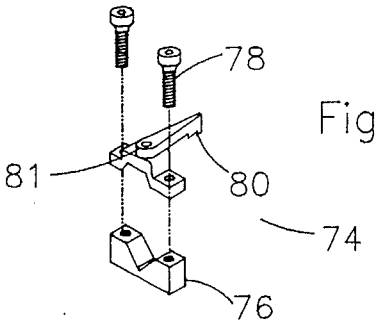
FIG. 5F is a perspective view of the quick release brackets.
Figure 5G:
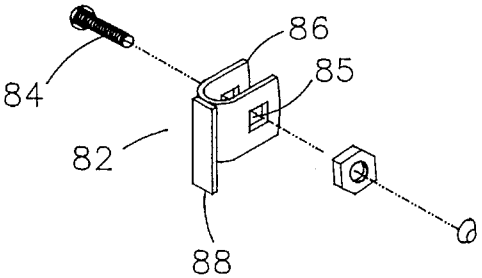
FIG. 5G is a perspective view of the tongue clamps.
Figure 5A:
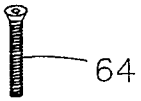
FIG. 5A is a perspective view of the cap screw.

Turning now to the hardware utilized by the quick-release means (28) of applicant's present invention, and with reference to FIGS. 5A through 5F, it is seen that applicant provides a number of components which allow the back and the seat of seating system (10) to be released quickly, easily and without the need of tools, from the frame of a wheelchair. Specifically, FIG. 5A illustrates a cap screw (64) which is utilized in a number of places. FIG. 5B illustrates three-holed "J" bracket (66) having a curved portion (66A) and a straight portion (66B). Walls defining holes (67) comprise part of straight portion (66B). Likewise, FIG. 5C illustrates nine-holed "J" bracket (68) having curved portion (68A), and straight portion (68B), the latter with walls defining holes (69).

FIG. 5D illustrates cylindrical spacer (70) capable of receipt therethrough of a screw or other fastening means. FIG. 5E illustrates five holed "J" bracket (72) having curved portion (72A) and straight portion (72B), the latter with walls defining holes (73). FIG. 5F illustrates quick release bracket (74) having bracket halves (76) for enclosing therewith in tubes of the wheelchair frame (see FIG. 6). Quick release bracket (74) has on one of bracket halves (76) a notched, pivoting, hold down arm (80) articulating from bracket half (76) at pivot pin (81). Screws or other fasteners (78) hold bracket halves (76) together on the wheelchair frame as is illustrated with reference to FIG. 6 and set forth in more detail below. FIG. 5G illustrates tongue clamps (82) having screws/lock nut combination (84) for receipt through holes (85) of "U" bracket (86). Tongue clamp (82) is comprised on "U" bracket (86) having tongue (88) projecting therefrom as set forth in FIG. 5G.

Figure 6:
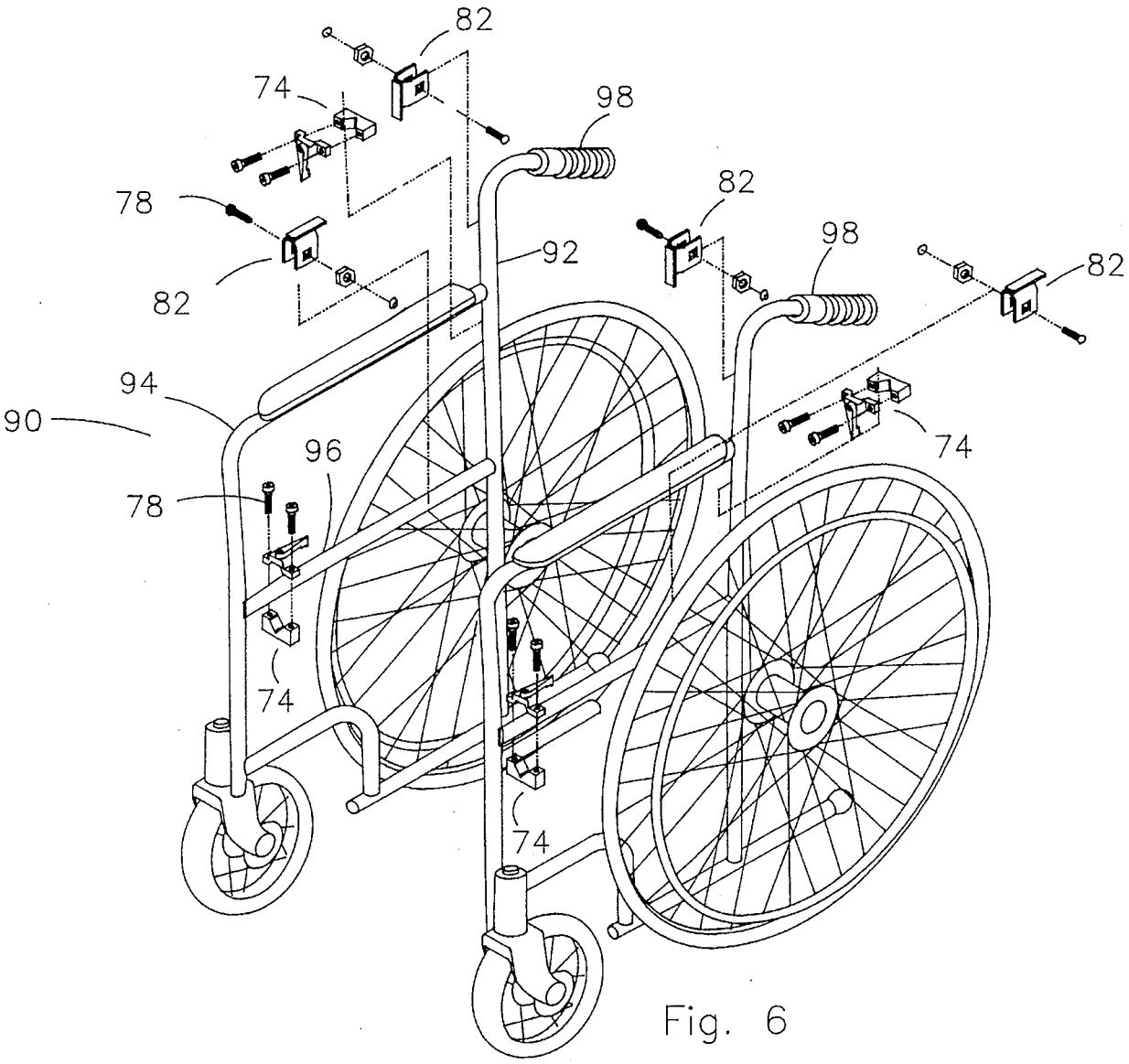
FIG. 6 is a perspective view showing, in exploded form, the manner in which the hardware of applicant's present invention attaches to the frame of the wheelchair.

FIG. 6 illustrates the manner in which the hardware of quick release means (28) attaches and the location at which such hardware is attached to wheelchair frame (90).

It is seen in FIG. 6 that wheelchair (90) is comprised of two vertically depending downtubes (92) from which, projecting horizontally and perpendicularly are two arm rails (94). Beneath the arm rails (94) and also trending perpendicularly to downtubes (92) are struts (96).

Basically, applicant's quick release system is comprised of eight brackets, two each on the struts and the down tubes between where struts (96) meet downtubes and handles (98). More particularly, quick release brackets (74) attach to a forward portion of struts (96) by attaching bracket halves such that they surround walls of strut (96) with screws (78) attaching the two halves. Tongue clamps (82) are attached to rear portions of struts (96) through the use of screws (78). Note that both quick release bracket (74) and tongue clamps (82) are attached with their tops on the top side of struts (96). Each of downtubes (92) likewise are provided with quick release brackets (74) and tongue clamp (82) on each side as illustrated in FIG. 6.

Figure 7:
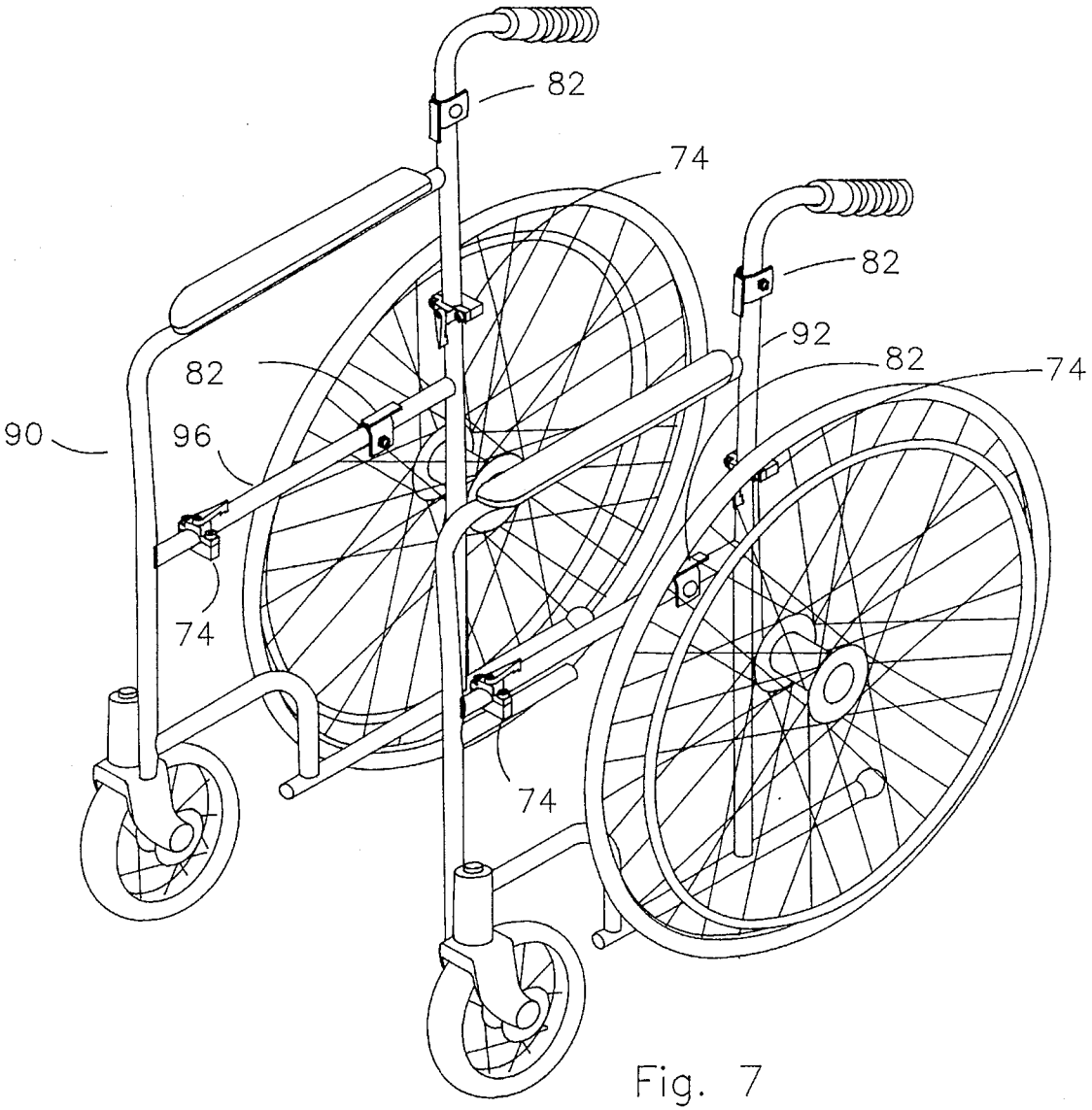
FIG. 7 is a perspective view, in exploded form, showing the manner in which the quick-release hardware attaches to the seat and back of applicant's invention, as well as the manner in which the harness attaches to the seat and back of applicant's present invention.

FIG. 7 illustrates wheelchair frame (90) with quick release means (28) attached thereto. In the configuration illustrated in FIG. 7, frame (90) is ready for installation of the seat/back portion of applicant's invention. It is further illustrated in FIG. 7 how components (74) and (82) of quick release means (28) may be positioned anywhere along struts (96) or downtubes (92) to position the seat (12) fore and aft with respect to frame (90) as well as to position back (14) up and down with respect to frame (90) and to accommodate patient's body frame.

Figure 8A:
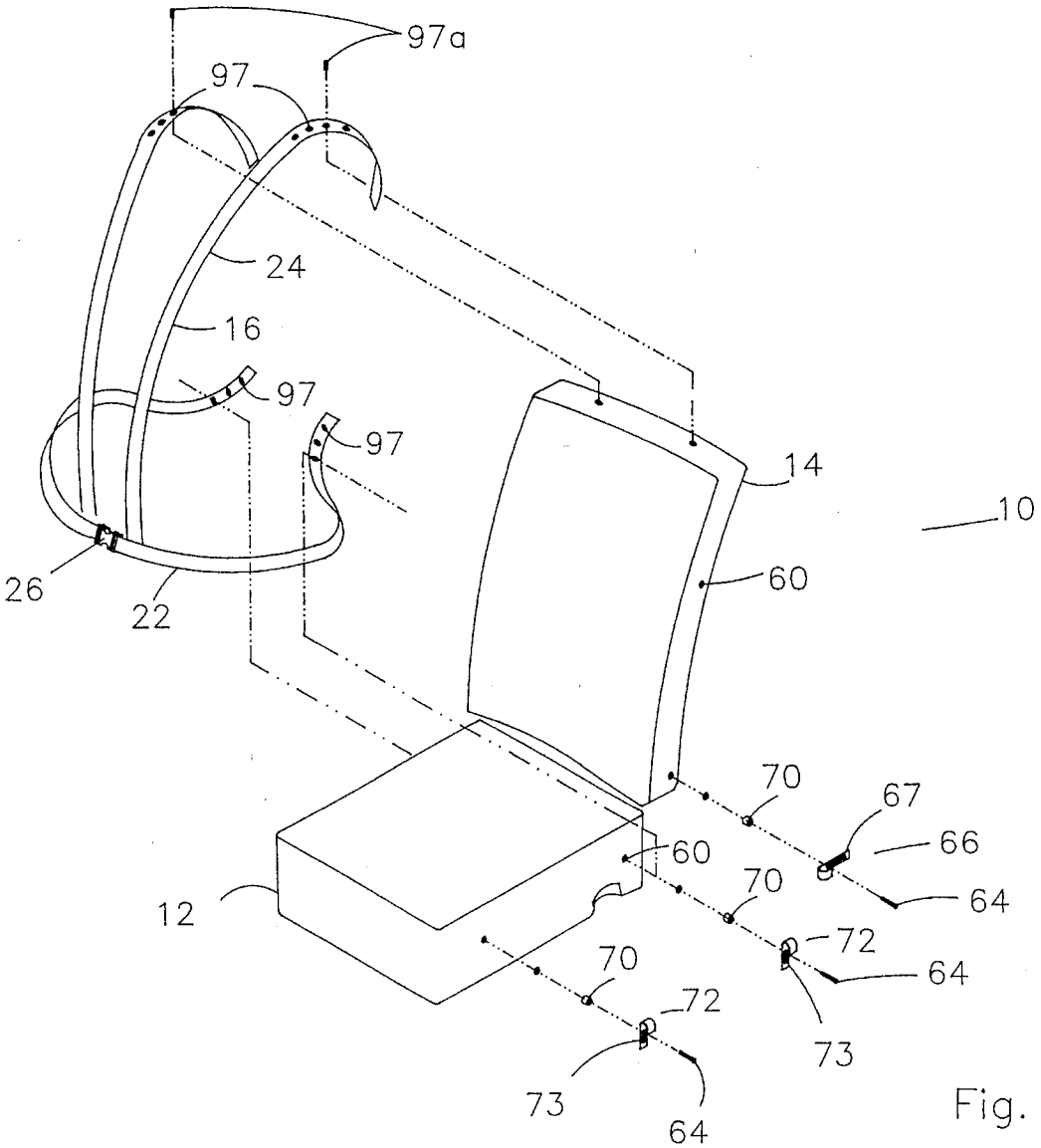
FIG. 8A is a perspective view of the frame of the wheelchair, illustrating the manner and position in which the quick-release hardware of applicant's present invention is secured to the frame.

Turning now to FIG. 8A, it is seen how the remainder of quick release means (28) is attached to seat (12) and back (14) portions, as well as the manner in which harness (26) is adjustably attached to the same. More particularly, FIG. 8A illustrates how quick release means (28) comprising three-holed "J" bracket (66), five-holed "J" bracket (72) and nine-holed "J" bracket (68) attaches to the side walls of seat (12) and back (14) through the use of screws (78) through one of holes (67, 69, or 73) to adjustably set the tilt. Note that by selectively locating screw (64) to any one of the various holes, the angular relationship between seat (12) and back (14) may be changed. More details of this adjustment are set forth with respect to the discussions of FIG. 4 above. FIG. 8 also illustrates the means in which harness (26) having a multiplicity of grommet holes (97) in lap belt (22) and shoulder straps (24) provides a means for adjusting harness (16) for different sized torsos. Specifically, fasteners (97*a*) and (64) will pass through grommet holes (97) and anchor the harness.

Figure 8C:
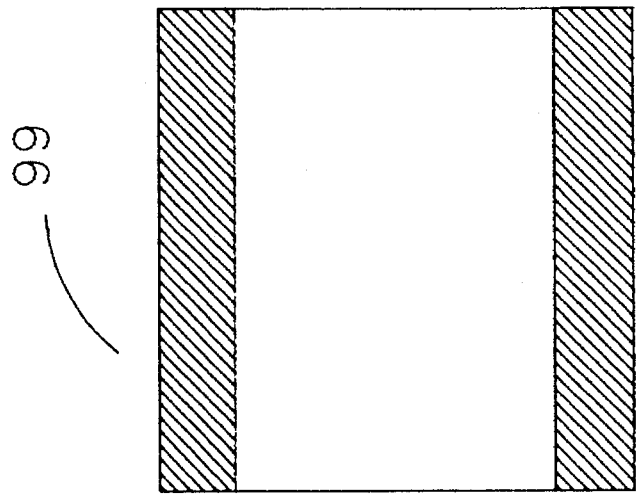
FIG. 8C is an end view of a shim of applicant's invention.
Figure 8B:
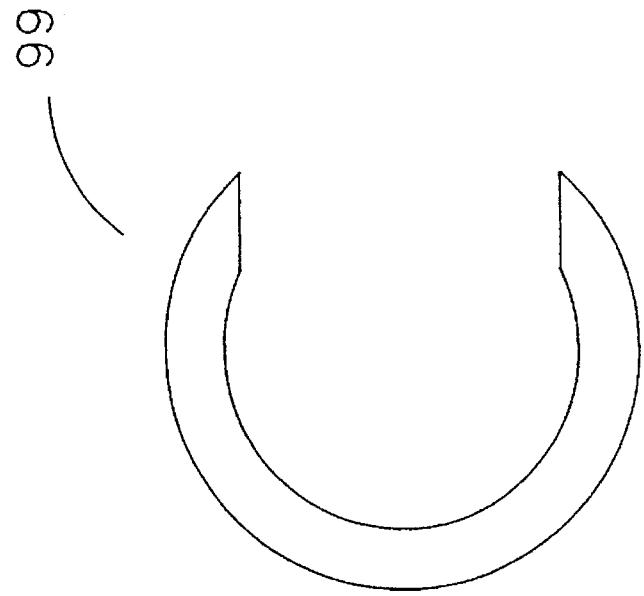
FIG. 8B is a side elevational view of a shim of applicant's invention.

FIGS. 8B and 8C illustrate views of a spacer or shim (99) for adapting the tongue clamps, J-hooks and quick release brackets to the frames of wheelchairs made of tubing having a smaller o.d. than 1", typically o.d.'s of either ⅞" or ¾". Shim (99) has an o.d. of 1" and an i.d. of either ⅞" or ¾" as required.

Figure 9:
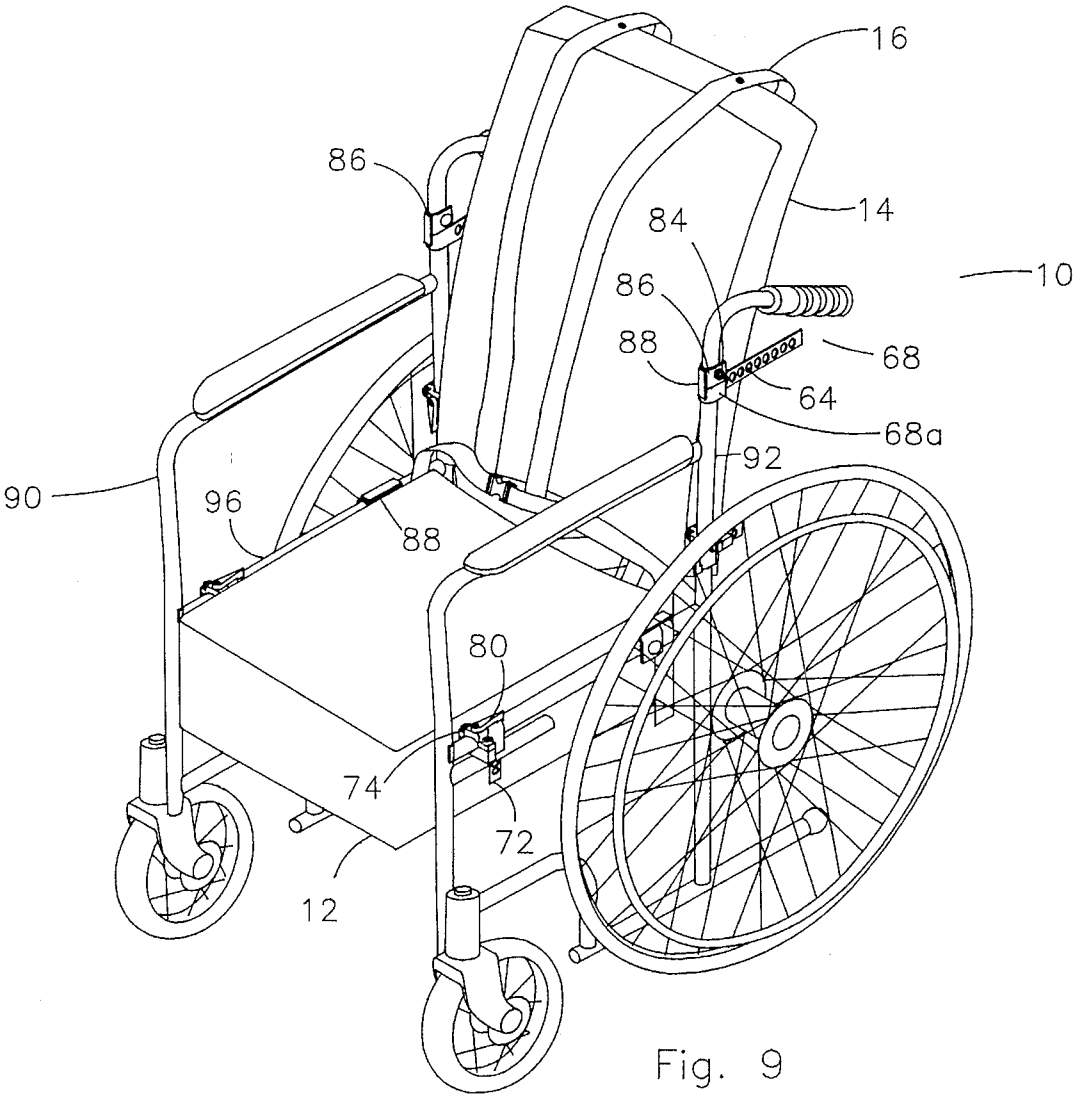
FIG. 9 is a perspective view of the wheelchair frame having the seating system of applicant's present invention attached thereto.

The seat and back connecting hardware and the manner in which it attaches to the seat and back of applicant's system is illustrated in FIGS. 8A and 9. The top two fasteners (97*a*)

are for attachment of the integrated safety harness to the back. The middle two fasteners provide either eight- or nine-hole J-hooks: either nine-hole J-hook (68) of FIG. 5C, eight-hole J-hook (106) of FIG. 12B, or slotted J-hook (122) FIG. 13B. These provide means for attachment of the back shell to the wheelchair frame by means of quick release fixtures (68) or (122) or by means of permanently attached fixtures (106) as set forth in more detail below. Specifically, the use of either fixtures (68), (122) or (106) at the location featuring nine-hole J-hook (68) provides for adjustment of tilt-back angle of the back.

Figure 11A:
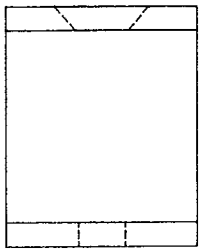
FIG. 11A is an end elevational view of an alternate three hole J-hook for use with applicant's present invention.
Figure 11B:
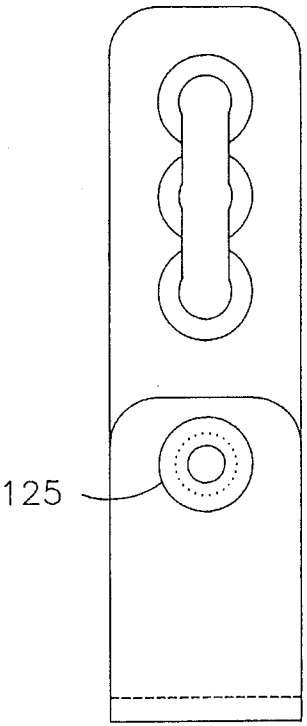
FIG. 11B is a front elevational view of an alternate three hole J-hook for use with applicant's present invention.

Quick release means hardware (28) is also provided in the form of quick release three-hole J-hook (66) or in the form of permanently attached three-hole J-hook (123), see FIG. 11B, to provide a means to pivot the seat back to allow for a variety of seat back angular adjustments.

FIG. 9 illustrates wheelchair frame (90) having thereon applicant's support system (10). It is noted how curved portions (66A, 68A and 72A) of "J" brackets (66, 68, and 72 respectively) are confined adjacent downtubes (92) or struts (96) by either notched, pivoting holed down arm (80) or tongue (88). Pivoting hold down arm (80) of the curved portion of the "J" brackets about 90 degrees from the position illustrated in FIG. 9 will allow "J" brackets held beneath tongues (88) of tongue clamps (82) to slide out. This will thereby release seat (12) and back (14) as well as quick release means (28) attached thereto to be removed from frame (90) for replacement or transfer to another frame, without changing the tilt back or fore and aft adjustment of the back with respect to the seat.

Thus, applicant provides a support system (10) easily attachable to and removable from a frame of a typical wheelchair, without the need for hand tools. Moreover, to initially attach various brackets of the quick release system to the wheelchair, only hand tools are needed and the frame of the wheelchair is not defaced, modified, or otherwise altered.

Figure 10A:
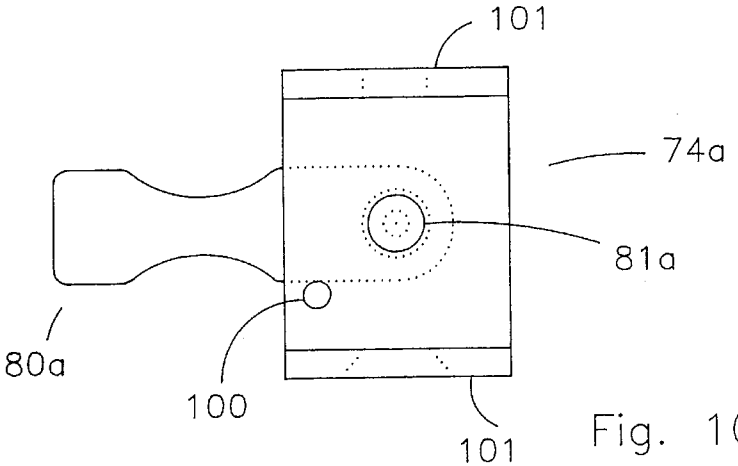
FIG. 10A is an end view of an alternate embodiment of a quick release bracket of applicant's present invention.
Figure 10B:
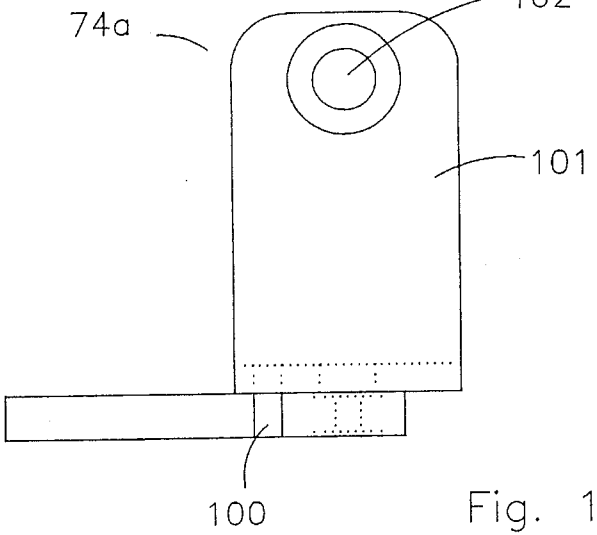
FIG. 10B is a side elevational view of an alternate quick release bracket of applicant's present invention.
Figure 10C:
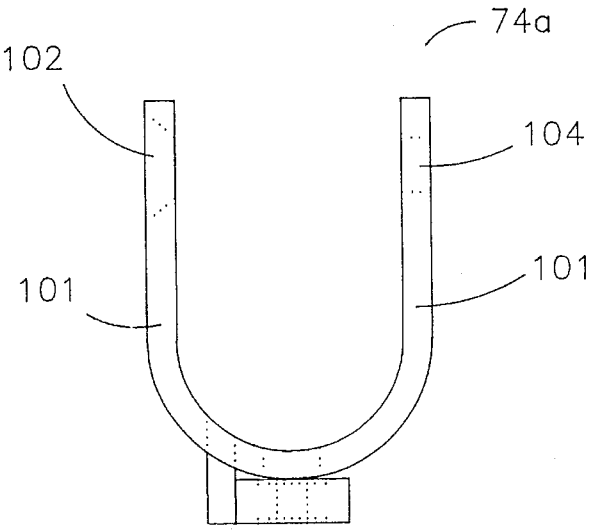
FIG. 10C is a front view of an alternate embodiment of a quick release bracket of applicant's present invention.

FIGS. 10A, 10B, and 10C represent views of an alternate preferred embodiment of quick release bracket (74A). Specifically, these figures illustrate alternate quick release brackets (74A) having a pivoting hold down arm (80A) articulated to rotate on pivot pin (S1A) and to abut stop boss (100). Note in particular how alternate quick release bracket (74A) differs from the quick release bracket (74) illustrated in FIG. 5F. Specifically, alternate quick release bracket (74A) has opposing wall members (101) which are intended to particularly enclose and partially extend beyond struts (96). Alternate quick release bracket (74A) is held in place snug against struts (96) by insertion of a fastener means such as a threaded bolt (not shown) through walls defining counter sunk hole (102) and through walls defining straight cut hole (104). In this manner, alternate quick release bracket is secured by a single fastener as opposed to the two required by the quick release embodiment of illustrated in FIG. 5F.

Figure 11C:
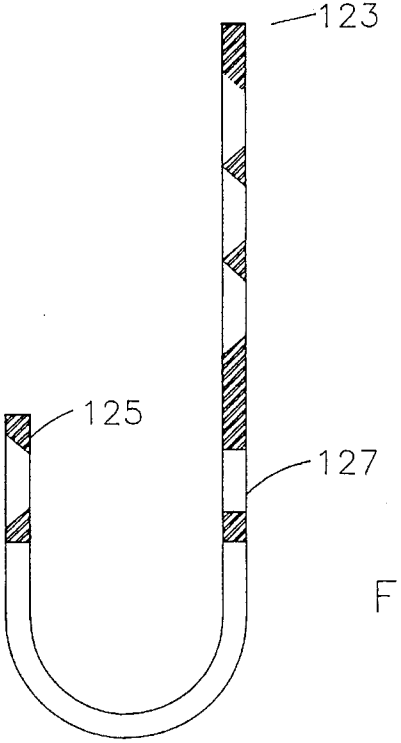
FIG. 11C is a side elevational view of an alternate three hole J-hook for use with applicant's present invention.

FIGS. 11A, 11B and 11C illustrate an alternate preferred embodiment of a 3-hole J-hook (123) similar to that illustrated in FIG. 5B with the exception that alternate preferred 3-hole J-hook (123) has wall portion (125) defining a countersunk hole in the tail of the J.

Straight-cut hole (127) near the base of the leg of the J as illustrated in FIG. 11C provides a means for inserting a fastener (not shown) through the holes illustrated after 3-hole J-hook (123) has been placed over the strut or frame member as illustrated in FIG. 9. The fastener when tightened will squeeze the curved portion of the J-hook against the strut to hold the J-hook in place on the frame without the need for the use of tongue clamps (88).

Figures 12A, 12B, 12C:
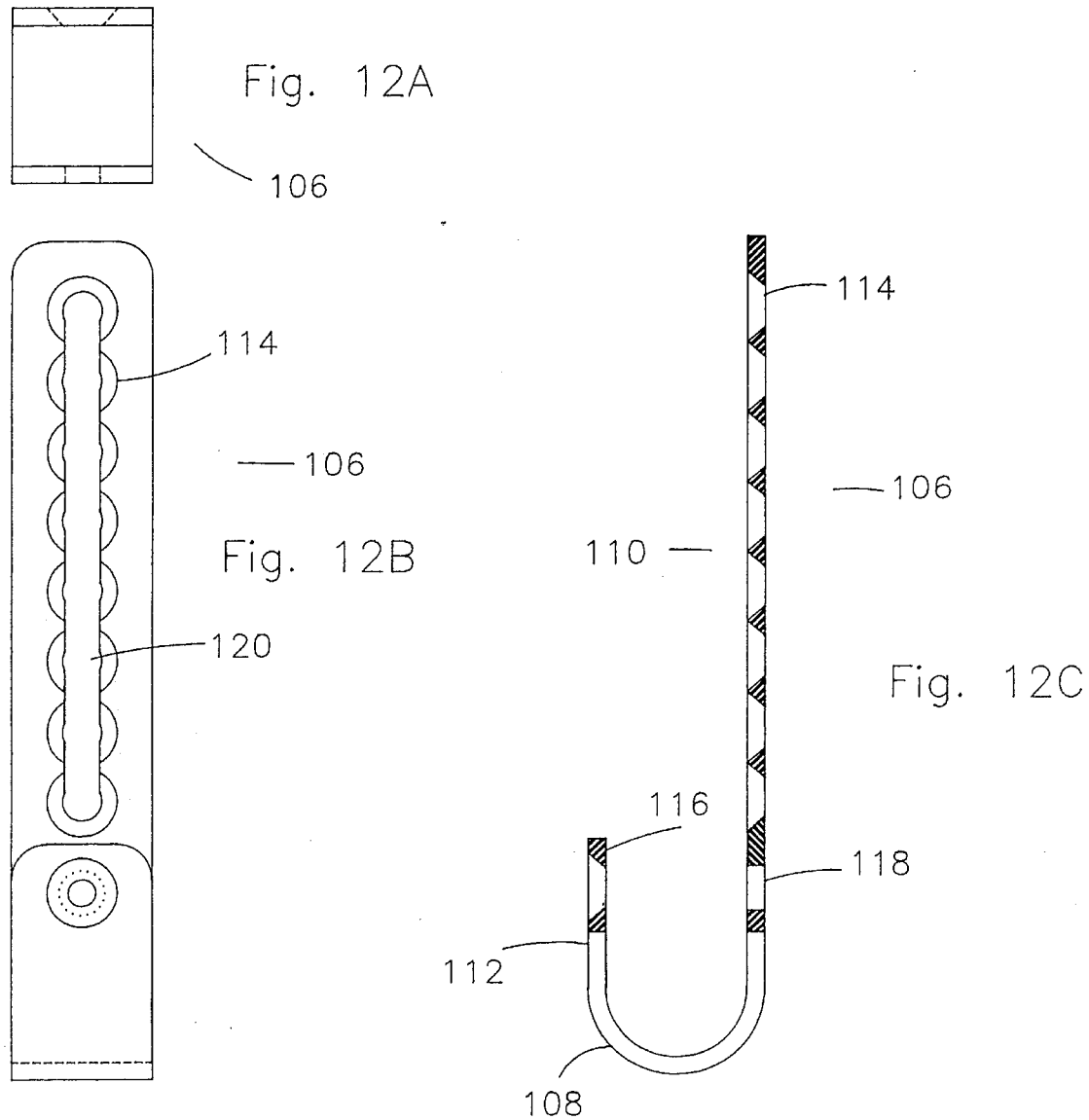
FIG. 12A is an end elevational view of an alternate preferred embodiment of a J-hook for use with applicant's present invention.
FIG. 12B is a front elevational view of an alternate preferred embodiment of a J-hook for use with applicant's present invention.
FIG. 12C is a side elevational view of an alternate preferred embodiment of a J-hook for use with applicant's present invention.

FIGS. 12A, 12B, and 12C represent views of a slotted eight-hole J-hook (106). Slotted eight-hole J-hook (106), has wall defining a U-shaped portion (108). Extending from the U-shaped portion is a straight long portion (110) and a straight short portion (112). Long portion (110) has walls defining counter sunk holes (114) dimensioned for the insertion and flush fit with a flanged head (125) of a fastener means (127). See FIG. 14. Likewise, short portion (112) has a single countersunk hole (116). Opposite countersunk hole (116) is straight cut hole (118) for receipt of a fastener means (not shown) therethrough.

However, as is illustrated in FIG. 12B, walls defining counter sunk holes (114) are joined by slot (120) to adjacent holes (114). Having slot (120) combined with counter sunk holes (114) allows the use of threaded fastener (127) having a large, finger loosened or finger tightened knob (129) to use as an adjustment knob. See FIG. 14. Using fastener (127) and a slotted J-hook such as that illustrated in FIGS. 14A–C in place of elements (66), (68), and (72) as illustrated in FIGS. 5B–E and placed on the wheelchair as illustrated and FIG. 8A will allow the patient or therapist to unloosen hand-tightened fastener (127) sufficient to clear the wall of holes (114) and to slide J-hook (106) along slot (120), until a desired position is reached, whereupon the fastener is tightened against hole (114). As can be seen with reference to FIG. 8A and nine-hole J-hook (68) in FIG. 9, those fasteners and J-hooks illustrated require the removal of cap screws (64) fully from holes (67), (69), and/or (73) and reinsertion into new holes to effect an adjustment up or down or front or back. In addition to slot (120), slotted J-hook (106) illustrates use of the counter sunk hole (116) in the tail of the "J" along with a straight cut hole at the base of the leg of the J, which, along with a fastener (not shown) inserted therethrough and threaded tight, will squeeze the frame of the wall members adjacent "U" portion (108) and effectively lock J-hook (106) in position on the frame of the wheelchair, in the manner described with reference to FIGS. 11A–C above.

The options illustrated in FIGS. 11A, 11B, 11C and 12A, 12B and 12C present hardware that will permanently attach to the frame of the chair and is typically not intended to be used to move the seat and back from one chair to the next. That is, the tightening of a bolt or other fastener through holes (125) and (127) or (116) and (118) will pinch the J-hook to the tube of the wheelchair frame. Tongue clamps will therefore not be required in this "permanent" or non-transferable format. Instead, but tools will be required to tighten the fasteners holding the J-hooks to the frame.

Figures 13A, 13B, 13C, 14:
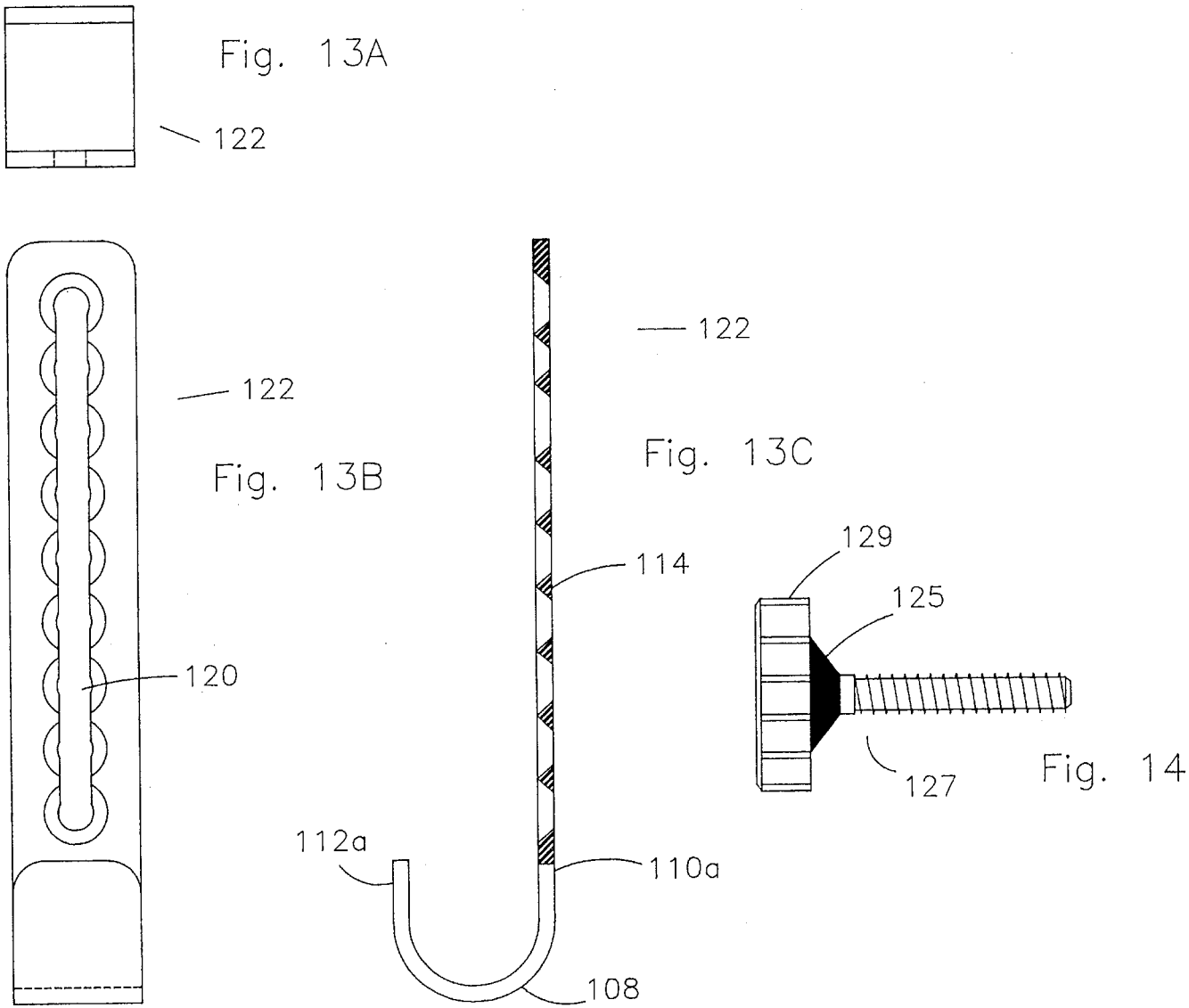
FIG. 13A is an end elevational view respectively of an alternate preferred embodiment of a nine hole J-hook for use with applicant's present invention.
FIG. 13B is a front elevational view respectively of an alternate preferred embodiment of a nine hole J-hook for use with applicant's present invention.
FIG. 13C is a side elevational view respectively of an alternate preferred embodiment of a nine hole J-hook for use with applicant's present invention.
FIG. 14 is a side elevational view of a fastener for use with applicant's present invention.

FIGS. 13A, 13B, and 13C illustrate a slotted J-hook eliminating, however, holes (116) and (118). Thus, J-hook (122) has "plain" (no holes) straight short portion (112A) and an straight long portion (110A) that eliminates hole (118) illustrated in FIG. 12C. This 9-hole adjustment of the system with this J-hook is the same manner as that disclosed in FIGS. 12A–C.

The hardware illustrated in FIGS. 13A–C is preferred to the embodiment illustrated in FIG. 5C as the former allows adjustment of tilt back throughout the day, as required by the patient, without the necessity of removing the fastener from slot 12D.

The unique slotted J-hooks and adjustment knob of applicant's system enables nurses or aides to change the recline angle without the use of tools. This feature is important as the patient's needs change throughout the day (i.e., sitting up to eat breakfast, perhaps reclining to take a nap.) The angle of recline can be adjusted by loosening the tension on the knob and sliding the knob to the desired position on the J-hook. The J-hook mounts to the pivot point connection and works in connection with the quick release features.

Applicant's system includes anchoring hardware and quick release hardware. The anchoring hardware is permanently attached to the seat and back shells. The quick release hardware (74), (74*a*) or (82), is attached to the various points on the wheelchair frame as set forth above. To use the quick release hardware, rotate the quick release levers to the unlocked position, slide the J-hooks from beneath the tongue clamps, and the back comes free from the frame. This way, the seat and back have been removed without changing any of the adjustments, all the J-hooks retain their original adjustment. Replacement of the seat and back is accomplished by positioning the seat and back next to the anchoring hardware and rotating the released levers to the locked position.

The quick release system has three distinct advantages over a fixed design—it transfers the wheelchair under a portable system (an asset for the working handicapped), it facilitates easy and thorough cleaning, and requires less storage space.

The use of applicant's specially designed plastic spacers (70) in FIG. 5D and (99) in FIGS. 8B and 8C allows applicant's system to be used universally with a variety of different-sized wheelchair frames. The function of these spacers is two-fold. They permit the use of applicant's system on a wide variety of wheelchair models by accommodating different frame dimensions as well as facilitating the attachment of various accessories, such as seat belts and harnesses.

Applicant's seat and back cover have seams on the bottom of the seat and back to eliminate moisture accumulation and subsequent degradation of the underlying foam. Moreover, applicant's use of a cover material which stretches in two directions eliminates the "sling effect" of typical wheelchair seat material which stretches only in one direction. Material which stretches in only one direction defeats some of the design aspects of the seat and back molded contours.

Applicant's safety harness provides for securing patients to the seat and back while eliminating horizontal restraints across the upper torso which would be uncomfortable for female patients and present a danger of choking to slumping patients. Further, applicant's harness allows release by the use of only a single buckle.

Finally, it is seen with reference to the specifications and figures set forth above, that applicant's system further includes a molded seat conforming to the general outline of the patient's posterior, with the addition of multiply, multi-density foam atop the molded shell. These features are provided in conjunction with an adjustable harness, quick-release hardware and the other novel fixtures described herein, to provide for a novel, superior, seating support system heretofore unavailable.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position or manner in which the invention may be constructed or used.

Although the invention has been described in connection with the preferred embodiment, it is not intended to limit the invention to a particular form set forth, but on the contrary, it is intended to cover such alternatives, modifications, and equivalents as may be included within the spirit and scope of the invention as defined by the appended claims.

What is claimed is:

1. An adjustable wheelchair patient support system attachable to a frame of a wheelchair, the system comprising:

a generally rectangular seat having a molded seat shell, the shell with a contoured top surface, a front wall, a pair of side walls and a rear wall pending from the top surface, said top surface of said shell overlain with a first foam layer wherein the first foam layer includes means for deformably softening on contact with a warm surface and covered with a first tough, durable cover;

a generally rectangular back having a molded back shell with a contoured front surface, depending top, bottom and side walls, said front surface of said back shell overlain with a second foam layer and covered with a second tough, durable cover;

a harness for securing a patient to said seat and said back, the harness having a lap belt and shoulder straps, and secured to the frame of the wheelchair; and attachment means for releasably attaching said seat and said back to said frame of said wheelchair, said attachment means further including adjustment means for selectively positioning said seat and said back to said frame, said adjustment means of said attachment means capable of maintaining the position selected when removing said system from a first frame of a first wheelchair and attaching said system to a second frame of a second wheelchair, wherein the adjustment means of said attachment means includes means to selectively adjust the seat fore and aft, up and down, and to tilt in angular relation to said back; and wherein the adjustment means of said attachment means includes means to selectively adjust the back up and down, fore and aft, and to tilt in angular relation to said seat; and wherein the first foam layer of said seat is comprised of two or more plies of at least two different densities; and wherein said harness includes quick release means for releasing the patient from said harness; and wherein the belt and the shoulder straps of said harness are adjustably mounted to said seat and said back; and wherein the shells of said seat and said back are formed of molded ABS and wherein said seat provides a depression positioned beneath the coccyx of the seated patient, a pair of buttock wells, a pair of leg channels, and said back provides a channel rearward of the spinal column of the seated patient; and wherein the cover of said seat and said back is comprised of fluid-proof two-way stretch vinyl.

2. The system of claim 1 wherein said attachment means is capable of attaching said seat and said back to the wheelchair without defacing or altering the frame of the wheelchair.

3. The system of claim 1 wherein the adjustment means of said attachment means includes means to adjust the back up and down, fore and aft, and in angular relation with said seat.

4. The system of claim 1, wherein said warm surface is about 98.6°.

5. The system of claim 1, wherein said densities of said plies are chosen so as to depend upon the weight of to be supported seated on said seat.

6. An adjustable wheelchair patient support system attachable to a frame of a wheelchair, said system comprising:

a generally rectangular seat having a molded seat shell, the shell with a contoured top surface, a front wall, a pair of side walls and a rear wall pending from the top surface, said top surface of said shell overlain with a first foam layer and covered with a first tough, durable cover, wherein said first foam layer of said seat includes means for deformably softening on contact with a warm surface and is comprised of two or more plies of at least two different densities;

a generally rectangular back having a back shell with a contoured front surface, depending top, bottom and side walls, said front surface of said back shell overlain with a second foam layer and covered with a second tough, durable cover;

a harness for securing the patient to said seat and said back, the harness having a lap belt and shoulder straps, and secured to said frame of said wheelchair; and attachment means for releasably attaching said seat and said back to said frame of said wheelchair, said attachment means further including adjustment means to selectively position said seat and said back relative to said frame, said attachment means capable of maintaining the position selected while removing or placing said seat and said back from or onto said frame, wherein the adjustment means of said attachment means includes means to selectively adjust the seat fore and aft, up and down, and to tilt in angular relation to said back; and wherein the adjustment means of said attachment means includes means to selectively adjust the back up and down, fore and aft, and to tilt in angular relation to said seat; and wherein said harness includes quick release means for releasing the patient from said harness; and wherein the belt and the shoulder straps of said harness are adjustably mounted to said seat and said back; and wherein the shells of said seat and said back are formed of molded ABS and wherein said seat provides a depression positioned beneath the coccyx of the seated patient, a pair of buttock wells, a pair of leg channels, and said back provides a channel rearward of the spinal column of the seated patient; and wherein the cover of said seat and said back is comprised of fluid-proof two-way stretch vinyl,

7. The system of claim 6, wherein the plies of different densities include at least one ply shaped to conform to the contoured top surface of the seat shell to lay in flush relation therewith and at least one ply having a planar shape overlying the shaped ply.

8. The system of claim 7, wherein the adjustment means of said attachment means includes a "J"-shaped hook, said hook having a leg portion with walls defining a plurality of counter sunk holes joined into a slot and a tail portion providing a threaded hole, said counter sunk holes formed so as to receive a fastener with a flanged head shaped to lay flush against the walls of the counter sunk holes and a threaded portion shaped for insertion through said counter sunk holes and engaging said threaded hole.

9. The system of claim 8, wherein the cover of said seat is capable of stretching in two directions.

10. The system of claim 6, wherein said attachment means further includes a knob attached to a threaded fastener with a splayed head portion and a threaded portion, the fastener capable of receipt through a slotted J-hook, said hook having a leg portion with walls defining a plurality of counter sunk holes joined into a slot, said fastener with the splayed head dimensioned to flushably engage the counter-sunk holes of said hook and the back shell of said back, said back shell formed so as to engage said threaded portion of said fastener.

11. The system of claim 10, wherein the width of said seat and said back are in the range of 14 to 16 inches, the distance between the front wall of said seat and the rear wall thereof is between 17 and 19 inches and the thickness of the seat and back shells is between 0.250 and 0.325 inches.

12. The system of claim 11, wherein the contour of the seat shell of said seat defines a coccyx relief depression and wherein the contoured surface of the back shell of said back defines a channel shaped surface spinal relief area.

13. The system of claim 6, further including a spacer formed to fit snugly between said attachment means and said frame of said wheelchair so as to adapt said attachment means to a variety of sizes of said frame of said wheelchair.

14. An adjustable wheelchair patient support system attachable to a frame of a wheelchair, said system comprising:

a generally rectangular seat having a molded seat shell, the shell with a contoured top surface, a front wall, a pair of side walls and a rear wall pending from the top surface, said top surface of said shell overlain with a first foam layer and covered with a first tough, durable cover, wherein said first foam layer of said seat includes means for deformably softening on contact with a warm surface and is comprised of two or more plies of at least two different densities;

a generally rectangular back having a back shell with a contoured front surface, depending top, bottom and side walls, said front surface of said back shell overlain with a second foam layer and covered with a second tough, durable cover;

a harness for securing the patient to said seat and said back, the harness having a lap belt and should straps, and secured to said frame of said wheelchair;

attachment means for releasably attaching said seat and said back to said frame of said wheelchair, said attachment means further including adjustment means to selectively position said seat and said back relative to said frame, said attachment means capable of maintaining the position selected while removing or placing said seat and said back from or onto said frame; and said attachment means further including a knob attached to a threaded fastener with a split head portion and a threaded portion, the fastener capable of receipt through a slotted J-hook, said J-hook having a leg portion with walls defining a plurality of counter-sunk holes joined into a slot, said fastener with the split head dimension to flushably engage the counter-sunk of said hook and the back shell of said back, said back shell formed so as to engage said threaded portion of said fastener, wherein the adjustment means of said attachment means includes means to selectively adjust the seat fore and aft, up and down, and to tilt in angular relation to said back; and wherein the adjustment means of said attachment means includes means to selectively adjust the back up and down, fore and aft, and to tilt in angular relation to said seat; and wherein said harness includes quick release means for releasing the patient from said harness; and wherein the belt and the shoulder straps of said harness are adjustably mounted to said seat and said back; and wherein the shells of said seat and said back are formed of molded ABS and wherein said seat provides a depression positioned beneath the coccyx of the seated patient, a pair of buttock wells, a pair of leg channels, and said back provides a channel rearward of the spinal column of the seated patient; and wherein the cover of said seat and said back is comprised of fluid-proof two-way stretch vinyl.

15. The system of claim 14, wherein said warm surface is about 98.6°.

16. The system of claim 14, wherein said densities of said plies are chosen so as to depend upon the weight to be supported on said seat.

17. An adjustable wheelchair patient support system attachable to a frame of a wheelchair, said system comprising:

a generally rectangular seat having a molded seat shell, the shell with a contoured top surface, a front wall, a pair of side walls and a rear wall pending from the top surface, said top surface of said shell overlain with a first foam layer and covered with a first tough, durable cover, wherein said first foam layer of said seat includes means for deformably softening on contact with a warm surface and is comprised of two or more plies of at least two different densities;

a generally rectangular back having a back shell with a contoured front surface, depending top, bottom and side walls, said front surface of said back shell overlain with a second foam layer and covered with a second tough, durable cover;

a harness for securing the patient to said seat and said back, the harness having a lap belt and should straps, and secured to said frame of said wheelchair;

attachment means for releasably attaching said seat and said back to said frame of said wheelchair, said attachment means further including adjustment means to selectively position said seat and said back relative to said frame, said attachment means capable of maintaining the position selected while removing or placing said seat and said back from or onto said frame; and a multiplicity of spacers formed to fit between said attachment means and the structural members of said frame of said wheelchair so as to adapt said attachment means to a variety of sizes of said structural members of said frame of said wheelchair, wherein the adjustment means of said attachment means includes means to selectively adjust the seat fore and aft, up and down, and to tilt in angular relation to said back; and wherein the adjustment means of said attachment means includes means to selectively adjust the back up and down, fore and aft, and to tilt in angular relation to said seat; and wherein said harness includes quick release means for releasing the patient from said harness; and wherein the belt and the shoulder straps of said harness are adjustably mounted to said seat and said back; and wherein the shells of said seat and said back are formed of molded ABS and wherein said seat provides a depression positioned beneath the coccyx of the seated patient, a pair of buttock wells, a pair of leg channels, and said back provides a channel rearward of the spinal column of the seated patient; and wherein the cover of said seat and said back is comprised of fluid-proof two-way stretch vinyl.

18. An adjustable wheelchair patient support system attachable to a frame of a wheelchair, said system comprising:

a generally rectangular seat having a molded seat shell, the shell with a contoured top surface, a front wall, a pair of side walls and a rear wall pending from the top surface, said top surface of said shell overlain with a first foam layer and covered with a first tough, durable cover, wherein said first foam layer of said seat deformably softens on contact with a warm surface and is comprised of two or more plies of at least two different densities;

a generally rectangular back having a back shell with a contoured front surface, depending top, bottom and side walls, said front surface of said back shell overlain with a second foam layer and covered with a second tough, durable cover;

a harness for securing the patient to said seat and said back, the harness having a lap belt and should straps, and secured to said frame of said wheelchair;

attachment means for releasably attaching said seat and said back to said frame of said wheelchair, said attachment means further including adjustment means to selectively position said seat and said back relative to said frame, said attachment means capable of maintaining the position selected while removing or placing said seat and said back from or onto said frame;

said attachment means further including a knob attached to a threaded fastener with a split head portion and a threaded portion, the fastener capable of receipt through a slotted J-hook, said J-hook having a leg portion with walls defining a plurality of counter-sunk holes joined into a slot, said fastener with the split head dimension to flushably engage the countersunk of said hook and the back shell of said back, said back shell formed so as to engage said threaded portion of said fastener; and a multiplicity of spacers formed to fit between said attachment means and the structural members of said frame of said wheelchair so as to adapt said attachment means to a variety of sizes of said structural members of said frame of said wheelchair.

* * * * *